United States Patent [19]

Christensen

[11] Patent Number: 4,800,785

[45] Date of Patent: Jan. 31, 1989

[54] DUAL-DRIVE RATCHET WRENCH

[76] Inventor: Wendell N. Christensen, 1304 Avondale Rd., Everett, Wash. 98204

[21] Appl. No.: 116,240

[22] Filed: Nov. 2, 1987

[51] Int. Cl.[4] ..... B25B 17/00

[52] U.S. Cl. ..... 81/57.29; 81/58.1; 81/58.3

[58] Field of Search ..... 81/58, 58.1, 58.3, 57.26, 81/57.27, 57.28, 57.29

[56] References Cited

U.S. PATENT DOCUMENTS

| | | | |
|---|---|---|---|
| 3,733,936 | 5/1973 | Flynn | 81/58.1 |
| 4,258,594 | 3/1981 | Welch | 81/58.1 |
| 4,406,184 | 9/1983 | Cockman | 81/58.1 |
| 4,532,832 | 8/1985 | Christensen | 81/58.1 |

*Primary Examiner*—Frederick R. Schmidt
*Assistant Examiner*—Blynn Shideler
*Attorney, Agent, or Firm*—Christensen, O'Connor, Johnson & Kindness

[57] ABSTRACT

A dual-drive ratchet wrench usable in either a reciprocating or nonreciprocating mode is disclosed. The ratchet wrench includes a wrench body having a head portion and a handle portion, a rotatable drive unit, a ratchet mechanism, and a sleeve assembly that is axially translatable along the handle portion. In the reciprocating mode, the sleeve assembly is moved to a disengaged position wherein the wrench is operated by swinging the handle back and forth through an arcuate path. Due to the action of the ratchet mechanism, the drive unit is forced to rotate when the handle portion is swung in one direction, but not the other. In the nonreciprocating mode, the sleeve assembly is moved to an engaged position, wherein an internal gear on the inside of the sleeve engages an external gear on a drive shaft that is coupled to the drive unit. The wrench is operated by rotating the sleeve assembly about an axial centerline through the handle of the wrench. Due to the interconnecting of the sleeve assembly with the drive unit through a bevel gear system, the drive unit rotates when the sleeve assembly is rotated. A retaining mechanism is included to retain the sleeve assembly is either the engaged or disengaged position.

6 Claims, 2 Drawing Sheets

Fig. 1.
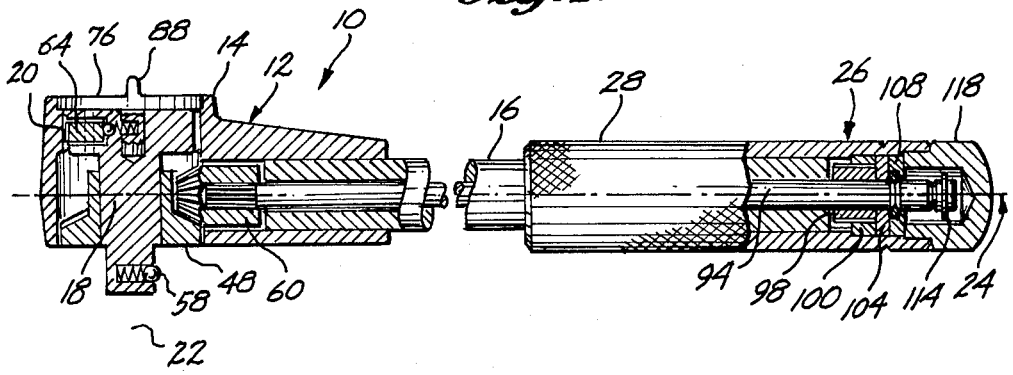
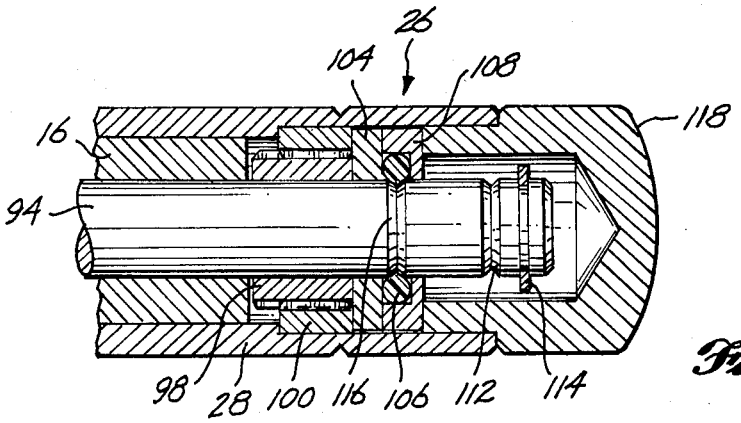
Fig. 3.
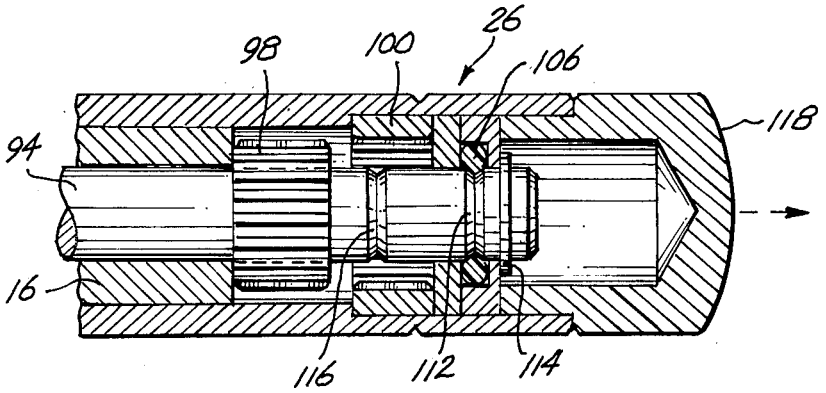
Fig. 4.

DUAL-DRIVE RATCHET WRENCH

TECHNICAL FIELD

This invention relates to hand tools and, more particularly, to ratchet wrenches of the type having a rectangularly-shaped drive lug to which an accessory tool having a complementary receptacle can be attached. Even more particularly, the present invention relates to an improvement to the wrench assembly disclosed in U.S. Pat. No. 4,532,832.

BACKGROUND OF THE INVENTION

Typically, a conventional ratchet wrench has an elongate handle attached to a head portion. The head portion contains a ratchet mechanism that causes the drive lug to rotate in a selected clockwise or counterclockwise direction when the handle is repeatedly swung back and forth through an arcuate path. In particular, when a fastener such as a bolt or screw is tightened or loosened, rotational force is applied to the fastener when the handle is swung arcuately in one direction, but the ratchet mechanism allows the wrench handle to be swung in the reverse direction without rotating the drive lug in the opposite direction and, hence, without applying force to the fastener.

Conventional ratchet wrenches perform adequately in many situations. However, when the space available around the fastener head restricts arcuate movement of the handle to a relatively small angle, a conventional ratchet wrench may be unusable or, at best, cumbersome and inconvenient to use. One proposed solution to this problem is a dual-mode ratchet wrench in which the drive lug can also be made to rotate when a sleeve-like section or portion of the handle is rotated about the longitudinal axis of the handle. In such arrangements, the sleeve-like section of the handle is coupled to the drive lug by means of a shaft and double gear system so that rotating or twisting the handle sleeve in one direction will cause the drive lug to rotate in the clockwise direction, while rotating the handle in the opposite direction will cause the drive lug to rotate counterclockwise.

One drawback of the prior art dual-mode ratchet wrenches results from the use of a locking mechanism for engaging and disengaging the sleeve-like handle region with the bevel gear and other elements of the associated drive system. Such a mechanism requires the person using the wrench to use both hands to perform a change in the mode of wrench operation and may require that the wrench be removed form the workpiece in order to accomplish the change. Removal and replacement of the ratchet wrench in a limited space situation is inconvenient and results in wasted time. Attempts have been made to provide a dual-mode wrench in which the mode of wrench operation can be selected with one hand. Such prior art arrangements of this type utilize a handle knob or sleeve that is permanently attached to a shaft that in turn is permanently coupled to the drive lug. The drawback to this arrangement is that as the wrench is used in its reciprocating mode, the handle will rotate in the operator's hand. Other prior art devices overcome this by incorporating a ratcheting mechanism in the sleeve to connect the sleeve to the drive shaft, thus preventing rotation of the sleeve in the operator's hand. This arrangement requires two ratcheting assemblies, one in the drive unit and one in the handle. This has the disadvantage of making the tool heavier and more difficult to operate. In addition, this configuration is complex and costly to manufacture.

SUMMARY OF THE INVENTION

In accordance with the present invention a dual-drive ratchet wrench is provided. The wrench body is configured to house a drive unit, a handle having a cylindrical bore, a drive shaft extending through the bore, and a sleeve surrounding the handle. One end of the drive shaft permanently engages the drive unit, and an external gear is located on the other end of the drive shaft engaged with an internal gear that is located on the interior of the sleeve. The sleeve is axially slidable along the handle to move the internal gear of the sleeve into and out of engagement with the external gear on the drive shaft. The sleeve is also rotatable about the handle to rotate the drive shaft and, consequently, the drive unit, when the internal gear is engaged with the external gear, thus permitting operation of the wrench in a nonreciprocating mode. The sleeve is freely rotatable when the internal gear on the sleeve is out of engagement with the external gear of the drive shaft, thus permitting operation of the wrench in a reciprocating mode.

In accordance with another aspect of the present invention, a retaining mechanism for retaining the internal gear on the sleeve in and out of engagement with the external gear on the drive shaft is provided. Preferably, the retaining mechanism comprises an O-ring attached to the sleeve and one or more grooves formed on the drive shaft for receiving the O-ring.

BRIEF DESCRIPTION OF THE DRAWINGS

The foregoing and other features and advantages of the present invention will be apparent to one skilled in the art after reading the following description taken together with the accompanying drawings in which:

FIG. 1 is a cross-sectional view of the dual-drive ratchet wrench formed in accordance with the present invention;

FIG. 3 is an enlarged, partial cross-sectional view of the handle assembly positioned in the nonreciprocating mode of operation; and FIG. 4 is an enlarged, partial cross-sectional view of the handle assembly positioned in the reciprocating mode of operation.

DETAILED DESCRIPTION

Figure 2:
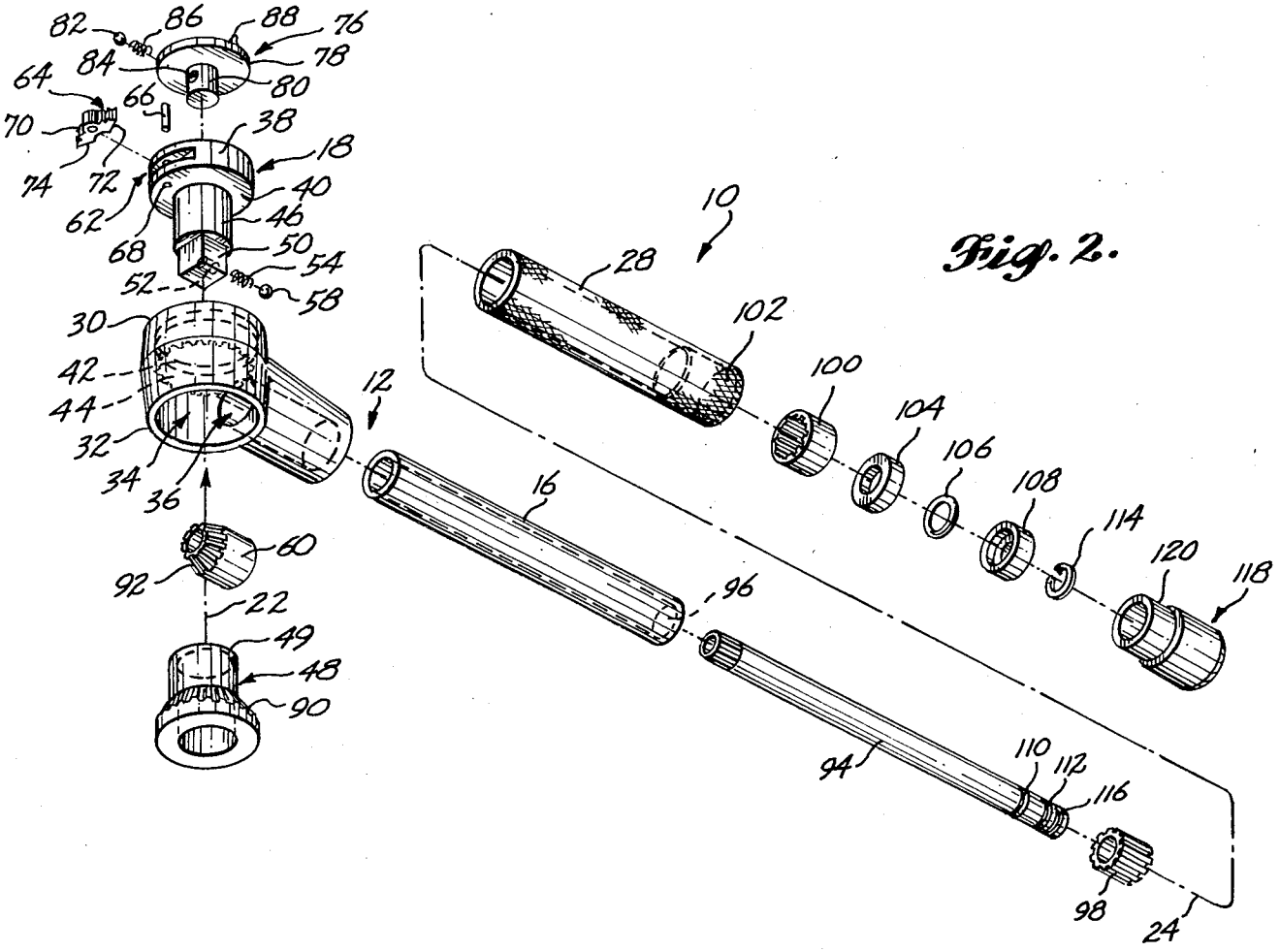
FIG. 2 is an exploded perspective view of the dual-drive ratchet wrench of FIG. 1.

FIGS. 1 and 2 show the construction and assembly of the dual-drive rachet wrench 10 constructed in accordance with the present invention. The wrench 10 includes an elongate wrench body 12 that has a head region 14 and a handle region 16, both of which house or support component parts of the ratchet wrench. A drive unit 18 housed in the head 14 contains part of a ratchet 20 that rotates the drive unit 18 when the handle 16 is swung or rotated about the axial centerline 22 of the drive unit 18. The axial centerline 22 is substantially perpendicular to the longitudinal axis 24 of the handle 16. A sleeve assembly 26, which is mounted on the handle 16, is movable toward and away from the head 14. The sleeve assembly 26 is in an engaged position when the sleeve 28 is positioned closest to the head 14 and in a disengaged position when it is positioned farthest from the head 14. The head 14 has an upper surface 30 and a lower surface 32 that are spaced apart and parallel to one another. A generally cylindrical aperture 34 passes through the head 14 between the upper and lower surfaces 30 and 32. An opening 36 extends from the aperture 34 to the outer surface of the head 14. The opening 36 is sized and shaped to slidably receive one end of the handle 16.

As best shown in FIG. 2, the drive unit 18 is formed of a one-piece, multi-diameter cylindrical member configured with steps of sequentially decreasing diameter from its upper to lower end. The outside diameter of the first section 38 is sized to fit within the cylindrical aperture 34 so that the lower surface 40 rests upon and is supported by a shoulder 42 of the aperture 34. The shoulder 42 is formed by the upper termini of teeth 44 that extend vertically along the circumference of the aperture 34 and inwardly therefrom. The second section 46 of the drive unit 18 extends downwardly and is sized for relatively close fit within a cylindrical opening within a sleeve 28 that is encircled by a miter gear 48. The second section 46 of drive unit 18 is followed by a third section in the shape of an rectangular drive lug 50, to which tool accessories such as drive sockets and the like (not shown) are attached.

To temporarily affix tool accessories such as conventional drive sockets to the drive lug 50, the drive lug 50 includes a radially extending cylindrical recess 52 configured for retaining a coil spring 54 and a friction ball 58. The coil spring 54, which is in compression between the friction ball 58 and the terminal wall of the recess 52, urges the friction ball outwardly so that a portion of the ball protrudes beyond the face of the drive lug 50. The protruding portion of the friction ball 58 slides into a complementary opening or recess within the drive lug recepticle of suitably configured tool accessories, thus retaining the tool accessory on drive lug 50 until the application of a pulling force sufficient to remove the accessory.

The drive unit 18 is held in the aperture 34 of the head 14 by the collar 49 and miter gear 48, with collar 49 being press fit over the second section 46 of the drive unit 18. The miter gear 48, when retained to the second section 46 of the drive unit 18, bears against a gear member 60 with the lower surface 40 of the drive unit 18 abutting the shoulder 42, thereby retaining the drive unit 18 within the aperture 34. The function of the gear member 60 will be described in more detail hereinafter. When the miter gear 48 is installed within the wrench head 14, the drive unit 18 is permitted to rotate about the axial centerline 22.

Referring still to FIG. 2, a slot 62 extends inwardly into the first section of the drive unit 18. Slot 62 houses a pawl 64 that pivots about a retaining pin 66 that is inserted in opening 68 that passes through the first section 38 of the drive unit 18. The pawl 64 includes teeth 70 that project beyond the slot 62 and engage the teeth 44 in the aperture 34 when the pawl 64 is pivoted about the retaining pin 66. Since the teeth in the first end 72 of the pawl 64 are configured to prevent counterclockwise rotation of the drive unit 18 relative to the wrench head 14 and the teeth in the second end 74 of the pawl 64 prevent clockwise rotation, the wrench 10 can be used for applying clockwise and counterclockwise force to a fastener or other workpiece by selective positioning of the pawl 64 and operation of the wrench 10 in the conventional, reciprocating mode.

The direction in which a workpiece can be rotated by the wrench 10 is controlled by a selector assembly 76 that is installed in a recess in the top of the drive unit 18. The selector assembly 76 includes a circular plate 78 having a solid, cylindrical projection 80 extending downwardly therefrom. A ball 82 that is installed in a radially extending guide hole 84 of the cylindrical projection 80 is urged into contact with the pawl 64 by a helical compression spring 86 that is positioned between the inner end of the ball 82 and the terminus of the guide hole 84.

In this arrangement, rotation of a rectangular projection 88 that extends diametrically across and upwardly from the upper surface of the circular plate 78 rotates the selector assembly 76 within the recess in the top of the drive unit 18 causing the outer end of the ball 82 to press against the pawl 64. When the selector assembly 76 is rotated clockwise, the ball 82 causes the teeth in the second end 74 of the pawl 64 to engage with the teeth 44 of the wrench head 14, thereby locking the drive unit 18 relative to the wrench head 14 during clockwise swinging movement of the handle 16. Rotation of the selector assembly 76 in the opposite direction causes engagement of the teeth in the first end 72 of the pawl 64 with the teeth 44 to thereby lock the drive unit 18 to the wrench head 14 during counterclockwise swinging movement of the handle 16. Since the ratchet 20 formed by the pawl 64 and the teeth 44 allows the handle 16 to be swung freely in a direction opposite to that selected, the wrench 10 can be used in the reciprocating mode of operation associated with conventional ratchet wrenches.

To allow the wrench 10 to be used in a nonreciprocating mode, the gear member 60, mentioned previously, is employed. As illustrated by FIGS. 1 and 2, the miter gear 48 is formed with an upwardly facing gear face 90 that is configured for engagement with the beveled gear face 92 of the gear member 60. A drive shaft 94 extends through a cylindrical bore 96 in the handle 16 and has one end attached to the gear member 60. Rotation of the drive shaft 94 about the longitudinal axis 24 causes the gear member 60 to rotate the miter gear 48, thus causing rotation of the drive unit 18. When the aforementioned components are assembled, the gear member 60 permanently engages the miter gear 48.

The free end of the drive shaft 94 is selectively engaged with the sleeve assembly 26. More particularly, in the currently preferred embodiment of the invention, an external gear 98 is fitted onto the free end of the shaft 94. To enable the drive shaft 94 to be rotated by the operator, the sleeve 28 is sized to fit over the outside diameter of the handle 16 and the external gear 98 affixed to the drive shaft 94. An internal gear 100 is attached to the distal end 102 of the sleeve 28. Sliding the sleeve 28 axially along the handle 16 toward the head 14 will cause the internal gear 100 on the inside of the sleeve 28 to pass into engagement with the external gear 98 on the drive shaft 94, thus enabling rotation of the drive shaft 94 by rotation of the sleeve 28.

To prevent the sleeve 28 from sliding off the handle 16, a washer 104 is slid over the drive shaft 94 and placed against the outside surface of the internal gear 100 on the sleeve 28. An elastic O-ring 106 is slid over the drive shaft 94 and held against the washer 104 by an O-ring retainer 108 that is likewise slid over the drive shaft 94. The O-ring retainer 108 is attached to the interior surface of the sleeve 28 by bonding or other suitable method. As the sleeve 28 is slid along the handle 16 in a direction away from the head 14, the elastic O-ring 106 will first come to rest in a first groove 110 circumscribing the outside surface of the drive shaft 94.

In this position, the elastic O-ring 106 holds the sleeve 28 in an engaged position such that the internal gear 100 on the sleeve 28 is engaged with the external gear 98 on the drive shaft 94. Application of sufficient force on the sleeve 28 will cause the O-ring 106 to be forced out of the first groove 110, thus allowing the sleeve 28 to slide away from the head 14. As the sleeve 28 slides along the handle 16 in a direction away from the wrench head 14, the O-ring 106 will come to rest in a second groove 112 formed circumferentially about the drive shaft 94. The second groove 112 is spaced a sufficient distance from the first groove 110 such that as the O-ring 106 rests within the second groove 112, the internal gear 100 on the sleeve 28 will be out of engagement and clear of the external gear 98 on the drive shaft 94 thus permitting free rotation of the sleeve 28 about the longitudinal axis 24.

To prevent the sleeve 28 from sliding further along the handle 16, a retaining ring 114 is installed in a third groove 116 formed circumferentially about the drive shaft 94 and positioned a sufficient distance from the second groove 112 to enable the O-ring 106 to remain resting in the second groove 112 as the O-ring retainer 108 rests against the retaining ring 114. To protect the sleeve assembly 28 from dust and moisture, an end cap 118 having a cylindrical projection 120 is sized to be slidably received within the distal end 102 of the sleeve 28. Preferably the cap 118 is bonded to the sleeve 28. However, the interior surface of the distal end 102 of the sleeve 28 and the exterior surface of the cylindrical projection 120 may be threaded to allow the end cap 118 to be threadably attached to the sleeve 28.

OPERATION

To use the wrench 10 in the reciprocating mode, i.e., by swinging the handle 16 about the axial centerline 22 through the drive unit 18, the sleeve assembly 26 is moved to the disengaged position by sliding the sleeve 28 away from the wrench head 14 so that the internal gear 100 on the sleeve 28 and the external gear 98 on the drive shaft 94 are not engaged. The direction in which a fastener or workpiece is to be rotated is selected by rotation of the selector assembly 76. If the workpiece is to be rotated in a clockwise direction, the second end 74 of the pawl 64 is engaged with the teeth 44 by rotating the selector assembly 76 in a counterclockwise direction. If the workpiece is to be rotated in a counterclockwise direction, the first end 72 of the pawl 64 is engaged with the teeth 44 by rotating the selector assembly in a clockwise direction. Once the sleeve assembly 26 has been disengaged and the selector assembly 76 positioned, the wrench 10 can be used as a conventional ratchet wrench.

To use the wrench 10 in the nonreciprocating mode, i.e., by axially rotating the sleeve 28, the sleeve assembly 26 is moved into the engaged position by sliding the sleeve 28 toward the head 14 so that the internal gear 100 on the inside of sleeve 28 engages the external gear 98 on the outside of the drive shaft 94. When the sleeve 28 is moved into the engaged position, the elastic O-ring 106 comes to rest in the first groove 110 to hold the sleeve assembly 26 in the engaged position. The direction in which a fastener or workpiece is to be rotated is selected in the same manner as when the wrench 10 is used in the reciprocating mode of operation. However, in the nonreciprocating mode, rotational force is applied to the workpiece by rotating the sleeve 28 about the handle 16, causing gear member 60 to drive the miter gear 48 and rotate the drive unit 81. To return to the reciprocating mode of operation, the sleeve 28 must be slid along the handle 16 in a direction away from the head 14. The resistive force exerted against the sleeve 28 by the resilient O-ring resting in the first groove 110 can be overcome by a one-hand movement of the sleeve 28. After the internal gear 100 on the sleeve 28 moves out of engagement with the external gear 98 on the drive shaft 94, the resilient O-ring 106 will come to rest in the second groove 112. Further movement of the sleeve 28 away from the head 14 is prevented by the O-ring retainer 108 contacting the retaining ring 114.

The present invention has been described in relation to a preferred embodiment. One of ordinary skill after reading the foregoing specification will be able to effect various changes, alterations, and substitutions or equivalents without departing from the broad concepts disclosed. It is therefore intended that the scope of the Letters Patent granted herein be limited only by the definitions contained in the appended claims and equivalents thereof.

The embodiments of the invention in which an exclusive property or privilege is claimed are defined as follows:

1. In a dual-drive ratchet wrench for operating in a reciprocating or nonreciprocating mode, the wrench having a body with a housing, a drive unit mounted within the housing, a handle having a longitudinal cylindrical bore, the handle depending from the housing, a drive shaft extending through the cylindrical bore of the handle with one end of the drive shaft permanently engaging the drive unit, and a sleeve surrounding the handle, the improvement comprising an external gear affixed to the unengaged end of the drive shaft, an internal gear located on the inside of the sleeve for engagement with the external gear, the sleeve being axially movable along the longitudinal axis of the handle between an engaged position wherein the internal gear is engaged with the external gear to connect the sleeve to the drive shaft, and a disengaged position wherein the internal gear is disengaged from the external gear to disconnect the sleeve from the drive shaft, the sleeve being rotatable about the longitudinal axis of the handle such that when the sleeve is in the engaged position, rotation of the sleeve will rotate the drive shaft, and thus the drive means, to thereby operate the wrench in the nonreciprocating mode, and when the sleeve is in the disengaged position, the sleeve will be freely rotatable about the longitudinal axis of the handle to permit operation of the wrench in the reciprocating mode without causing rotation of the sleeve.

2. The improvement claimed in claim 1, further comprising a retaining means for retaining the first engaging member on the sleeve in and out of engagement with the second engaging member on the drive shaft.

3. The improvement claimed in claim 2, wherein said retaining means comprises an O-ring attached to the sleeve and one or more grooves formed on the drive shaft for receiving said O-ring.

4. In a dual-drive ratchet wrench for operating in a reciprocating or nonreciprocating mode, the wrench having a body with a housing, a drive unit mounted within the housing, a handle having a longitudinal cylindrical bore, the handle depending from the housing, a drive shaft extending through the cylindrical bore of the handle with one end of the drive shaft permanently engaging the drive unit, and a sleeve surrounding the handle, the improvement comprising an external gear affixed to the unengaged end of the drive shaft and an internal gear located on the sleeve for engagement with the external gear on the drive shaft, the sleeve being axially slidable along the longitudinal axis of the handle to move said internal gear into and out of engagement with said external gear on the drive shaft, the sleeve being disconnected from the drive shaft when the internal gear is out of engagement with the external gear, and the sleeve being rotatable about the longitudinal axis of the handle to rotate the drive shaft, and thus the drive means, when the internal gear on the sleeve is in engagement with the external gear on the drive shaft to thereby operate the wrench in the nonreciprocating mode, and the sleeve being freely rotatable about the longitudinal axis of the handle when the internal gear on the sleeve is moved out of engagement with the external gear on the drive shaft to permit operation of the wrench in the reciprocating mode.

5. The improvement claimed in claim 4, further comprising a retaining means for retaining said internal gear on the sleeve in and out of engagement with said external gear on the drive shaft.

6. The improvement claimed in claim 5, wherein said retaining means comprises an O-ring attached to the sleeve and one or more grooves formed on the drive shaft for receiving said O-ring.

* * * * *

UNITED STATES PATENT AND TRADEMARK OFFICE

CERTIFICATE OF CORRECTION

PATENT NO. : 4,800,785

DATED : January 31, 1989

INVENTOR(S) : Christensen

It is certified that error appears in the above-identified patent and that said Letters Patent is hereby corrected as shown below:

Column 1, line 52, "form" should be --from--

Column 2, line 52, "rachet" should be --ratchet--

Column 3, line 34, "recepticle" should be --receptacle--

Column 6, line 1, "81" should be --18--

Signed and Sealed this

Twenty-eighth Day of November 1989

*Attest:*

JEFFREY M. SAMUELS

*Attesting Officer* *Acting Commissioner of Patents and Trademarks*